United States Patent [19]

Schroeder

[11] Patent Number: 4,494,392

[45] Date of Patent: Jan. 22, 1985

[54] APPARATUS FOR FORMING AN EXPLOSIVELY EXPANDED TUBE-TUBE SHEET JOINT INCLUDING A LOW ENERGY TRANSFER CORD AND BOOSTER

[75] Inventor: Joseph W. Schroeder, Clark, N.J.

[73] Assignee: Foster Wheeler Energy Corporation, Livingston, N.J.

[21] Appl. No.: 442,985

[22] Filed: Nov. 19, 1982

[51] Int. Cl.[3] ..... B21D 26/02

[52] U.S. Cl. ..... 72/56; 29/421 E

[58] Field of Search ..... 72/56; 29/421 E; 102/275.4

[56] References Cited

U.S. PATENT DOCUMENTS 3,672,035 6/1972 Lieberman ..... 29/421 E 3,893,395 7/1975 Kilmer ..... 102/275.4

*Primary Examiner*—Leon Gilden

*Attorney, Agent, or Firm*—Marvin A. Naigur; John E. Wilson; Warren B. Kice

[57] ABSTRACT

Apparatus for expanding a tube into a bore formed in tube sheet in which a primary explosive containing a relatively high number of grains of explosive per unit length extends within the tube coextensive with that portion of the tube to be expanded. An energy transfer cord extends between a detonator and the primary explosive and includes a relatively low number of grains of explosive per unit length which are insufficient to detonate the primary explosive but which be covered by a sheath to contain the debris and gases associated with the explosion of the latter explosive. A booster extends between the energy transfer cord and the primary explosive and contains an explosive which is detonatable by the energy transfer cord and, upon exploding, detonates the primary explosive.

13 Claims, 4 Drawing Figures

APPARATUS FOR FORMING AN EXPLOSIVELY EXPANDED TUBE-TUBE SHEET JOINT INCLUDING A LOW ENERGY TRANSFER CORD AND BOOSTER

BACKGROUND OF THE INVENTION

This invention relates to an apparatus for explosively forming a tube-tube sheet joint and, more particularly, to such an apparatus utilizing an explosive extending within the tube to be expanded.

Many current designs of heat exchangers feature the use of a plurality of heat exchange tubes disposed within a tube sheet and adapted to receive a primary fluid which is passed through the tubes in a heat exchange relationship with a secondary fluid passing over the tubes.

Various techniques have evolved for securing the tubes within the tube sheet. For example, the tubes have been mechanically expanded into the tube sheets utilizing a mandrel or the like, or by rolling, i.e., by applying an outward radial force against the entire surface of the tubes. However, these techniques enjoy several disadvantages including local metal deformation, general lengthening of the tubes, and the application of axial stresses on the tube weld and compressive strains in the tube wall.

In order to overcome the foregoing disadvantages, a technique of explosively forming the tubes within the tube sheet has evolved. According to this technique, an explosive charge is disposed within the area of overlap between the tubes and the tube sheet and is surrounded by a force transmitting member which, upon detonation of the explosive charge, expands the tube uniformly against the inner wall of the tube sheet.

One of the most popular explosives for use in this type of environment is generally known as detonating cord and is actually a high explosive fuse which is comprised of a woven fabric tube reinforced with wrappings of fiber and plastic or metal, and may be impregnated with asphalt and wax, and filled with a core of high explosive such as pentaerythritol tetranitrate (PETN). This explosive fuse is sufficient to adequately expand the tubes within the tube sheets in this type of application but enjoys the disadvantage of generating a relatively large amount of debris and gases. Since the common practice is to extend the explosive fuse externally of the tubes and to an externally-located detonator cap or the like, it can be appreciated that the foregoing debris and gases are unacceptable in many industrial applications, not the least of which is in connection with nuclear heat exchanger explosive expansion work.

SUMMARY OF THE INVENTION

It is therefore an object of the present invention to provide an apparatus for securing a tube within a tube sheet in which the tube is explosively formed within the tube sheet without the disadvantages set forth above.

It is a more specific object of the present invention to provide an apparatus of the above type in which the tubes are expanded in the foregoing manner without the production of debris and gases.

It is still further object of the present invention to provide an apparatus of the above type in which a primary explosive fuse is placed within the tube and is connected to the detonator cap by means of a energy transfer cord which contains a relatively low number of grains per foot of explosive and which is surrounded by a sheath that contains the products of combustion.

It is a still further object of the present invention to provide an apparatus of the above type in which a booster charge unit is disposed between the primary explosive fuse in the tubes and the energy transfer cord.

Toward the fulfillment of these and other objects a primary explosive containing a relatively high number of grains of explosive per unit length is disposed within each tube coextensive with that portion of the tube to be expanded. An energy transfer cord extends between a detonator and the primary explosive and includes a relatively low number of grains of explosive per unit length. A sheath covers the latter grains of explosive, and is constructed and arranged to contain the debris and gases associated with the explosion of said latter grains of explosive. Since the explosive associated with the energy transfer cord is insufficient to detonate the primary explosive, a booster extends between the energy transfer cord and the primary explosive and is detonatable by the energy transfer cord and operates to detonate the primary explosive.

DESCRIPTION OF THE DRAWINGS

The above brief description, as well as further objects, features and advantages of the present invention will be more fully appreciated by reference to the following detailed description of the presently preferred but nonetheless illustrative embodiment in accordance with the present invention when taken in conjunction with the accompanying drawings in which.

DESCRIPTION OF THE PREFERRED EMBODIMENT

Figure 1:
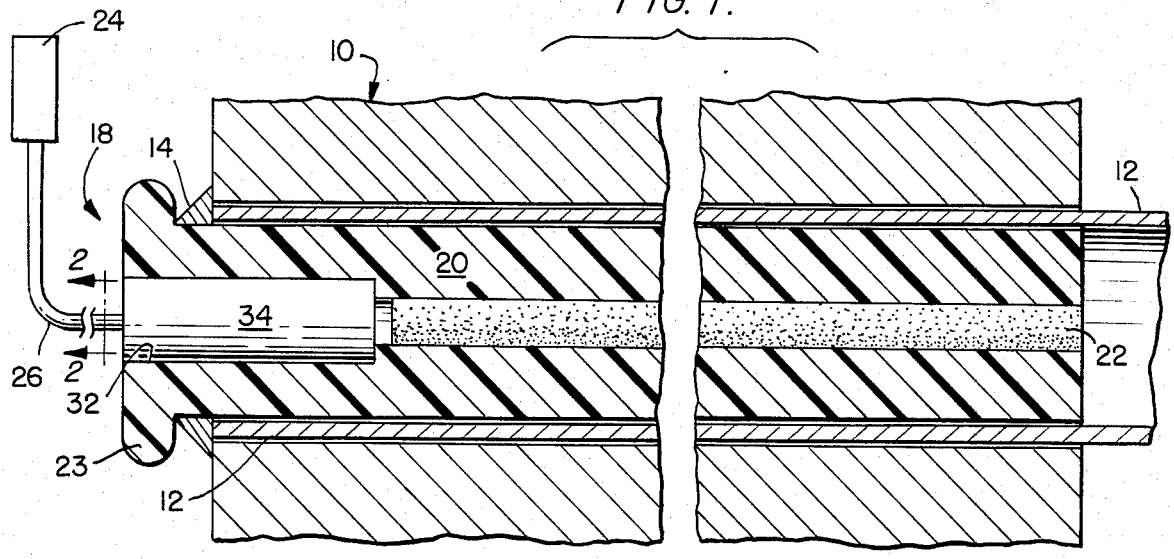
FIG. 1 is a longitudinal cross-sectional view of a tube-tube sheet interface including the apparatus of the present invention.

Referring to FIG. 1 of the drawings, the reference numeral 10 refers in general to a tube sheet which can form a portion of a heat exchanger having a plurality of heat exchange tubes, one of which is shown by the reference numeral 12. Each tube 12 extends within a corresponding bore formed within the tube sheet 10, with one end of each of the tubes extending flush with the end of the tube sheet, and the other end extending through the other end of the tube sheet.

The outer diameter of the tube 12 is slightly less than the inner diameter of the tube sheet bore and the tube may be secured to the tube sheet 10 by an annular weldment 14 which welds the flush end of the tube to the corresponding end portion of the tube sheet. Only a portion of the tube 12 is shown in the interest of clarity, it being understood that the heat exchanger would also include a vessel enclosing the tube sheet and having suitable inlets and outlets for a primary heat exchange fluid and a secondary heat exchange fluid. According to a typical arrangement of this type, the tubes 12 could be U-shaped with both ends of each tube extending through the tube sheet 10 and the heat exchanger would include a partition, or the like. The primary heat exchange fluid would enter the tubes 12 through one end from an area to the left of the tube sheet 10 as viewed in FIG. 1, pass through the tubes in a heat exchange relation with the secondary fluid passing through the vessel above the tube sheet, and exit through the other ends of the tubes to the area below the tube sheet.

The tube 12 in FIG. 1 is depicted within the tube sheet 10 prior to it being explosively formed in the tube sheet, along with the apparatus of the present invention for effecting the explosive forming. The latter apparatus includes an insert, shown in general by the reference numeral 18, which extends within the tube 12 and consists of a generally tubular force transmitting member 20 and a central explosive member 22 extending within the tubular member. The tubular member 20 has an outside diameter which is slightly less than the inner diameter of the tube 12, and a shoulder 23 is provided on the end of the tubular member which engages the weldment 14 to precisely locate the tubular member 20, and therefore the entire insert 18, within the tube 12. The length of the members 20 and 22 are such that when positioned within the tube as shown, they are substantially coextensive with the area of overlap between the tube 12 and tube sheet 10.

The explosive member 22 extends along the length of the tube 20 and the grains of explosive contained therein are uniformly disposed along its axis.

A detonator cap 24 is provided externally of the tube sheet 10 and the tubes 12 and contains a very sensitive primary explosive which detonates readily when set off by a primer, an electrical blast cap, or the like, in a conventional manner.

Figure 2:
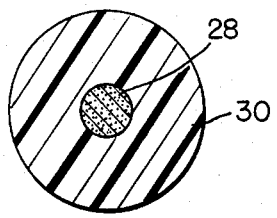
FIG. 2 is a cross-sectional view taken along the line 2—2 of FIG. 1.

An energy transfer cord 26 connects the detonator cap 24 with the insert 18. As better shown in FIG. 2, the energy transfer cord 26 includes a central core 28 which contains a relatively low number of grains of explosive, surrounded by a protective sheath 30, preferably of a plastic material. The relative size of the sheath when compared to the explosive potential of the explosive in the core 28 is such that the sheath will contain the debris and gases resulting from the explosion as will be described in detail later.

Referring again to FIG. 1, a counterbore 32 is formed in the member 20 for receiving a booster 34, with the outer surface of the booster 34 extending flush with the member 20 and connected to the other end of the energy transfer cord 26.

Although not clear from the drawings, it is understood that the other end of the booster 34 is formed with a relatively small cavity in which an explosive is disposed, with the booster being positioned so that the explosive does not fall outside of the axial location of the tube sheet 10. It is noted that the corresponding end of the explosive member 22 is spaced very slightly from the latter end portion of the booster 34.

The booster 34 is detonated by the energy transfer cord 26 which, in turn, detonates the explosive member 22 to effect the expansion of the tube 12 in the manner described above. The booster 34 is necessary since, in order to properly contain the debris and gases resulting from the detonation of the energy transfer cord 26, the amount of explosives contained in the latter cord must be kept below that which is necessary to directly detonate the explosive member 22.

This arrangement thus provides a distinct advantage over prior art arrangements in which a primary explosive fuse was extended out externally of the tube and connected directly to the detonator cap since the explosion of the fuse would cause debris and gases to be formed which are unacceptable in many industrial applications. According to the present invention, by providing the energy transfer cord 26 containing a relatively low number of grains of explosive, the debris and gases can be contained within the sheath 30, thus completely eliminating this problem.

Figure 3:
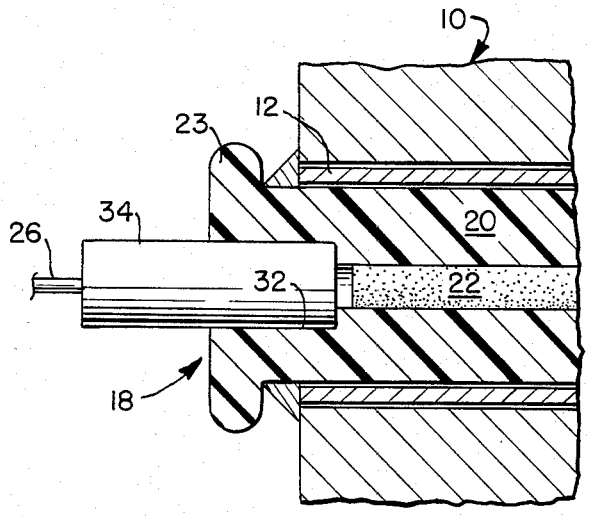
FIG. 3 is a partial view, similar to FIG. 1, but depicting an alternative embodiment of the present invention.
Figure 4:
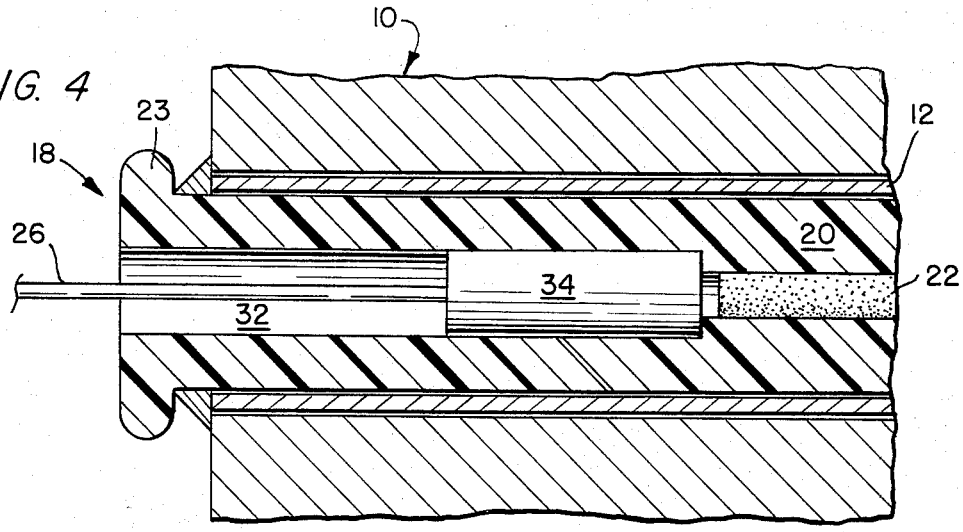
FIG. 4 is a view similar to FIG. 1, but depicting another alternative embodiment of the present invention.

The embodiments of FIGS. 3 and 4 are similar to that of FIG. 1 and identical components are given the same reference numbers. According to the embodiment of FIG. 3, a portion of the booster 34 extends within the counterbore 32 and the remaining portion projects from the counterbore 32 as shown. In this embodiment, the explosive member 22 extends in a slightly spaced relationship to the corresponding end of the booster 34.

The embodiment of FIG. 4 is designed for special applications in which selective expansion of the tube 12 is desired. In this particular example, it will be assumed that it is not desired to expand that portion of the tube 12 extending from the end of the tube sheet to a fairly significant distance into the tube sheet. According to this embodiment, the counterbore 32 extends a distance corresponding to that portion of the tube that is not to be expanded, and the booster 34 is disposed in the counterbore 32 as shown. The explosive member 22 extends in a slightly spaced relationship to the corresponding end of the booster 34 as in the previous embodiments and, otherwise, the remaining components are identical.

It is understood that several other variations may be made in the foregoing without departing from the scope of the invention. For example, the exact materials used, including the number and type of explosives, in the various components can be varied within the scope of the invention.

A latitude of modification, change and substitution is intended in the foregoing disclosure and in some instances some features of the invention will be employed without a corresponding use of other features. Accordingly, it is appropriate that the appended claims be construed broadly and in a manner consistent with the spirit and scope of the invention therein.

What is claimed is:

1. Apparatus for expanding a tube into a bore formed in a tube sheet, comprising primary explosive means containing a relatively high number of grains of explosive per unit length and extending within said tube coextensive with that portion of the tube to be expanded; an annular force transmitting member extending between said primary explosive means and said tube for transferring to said tube the energy resulting from the explosion of said primary explosive means; detonator means disposed externally of said tube; an energy transfer cord extending between said detonator means and said primary explosive means, said energy transfer cord including a relatively low number of grains of explosive per unit length which are insufficient to detonate said primary explosive means, and a sheath covering said latter grains of explosive, and being constructed and arranged to contain the debris and gases associated with the explosion of said latter grains of explosive; and booster means extending between said energy transfer cord and said primary explosive means, said booster means containing an explosive which is detonatable by said energy transfer cord and, upon exploding, is sufficient to detonate said primary explosive means.

2. The apparatus of claim 1 wherein a counterbore is formed in said force transmitting member adjacent one end thereof, said booster means being at least partially disposed in said counterbore and engaging in a friction fit with the wall of said force transmitting member defining said counterbore.

3. The apparatus of claim 2 wherein said booster means extends completely within said counterbore and flush with the end of said force transmitting member.

4. The apparatus of claim 2 wherein a portion of said booster means extends within said counterbore and a portion projects from said counterbore.

5. The apparatus of claim 2 wherein said booster means extends completely within said counterbore and in a spaced relation to said one end of said force transmitting member.

6. The apparatus of claim 1 wherein said booster means is connected at one end to said energy transfer cord and its other end extends in a closely spaced relation to said primary explosive means.

7. Apparatus for expanding a tube into a bore formed in a tube sheet, comprising primary explosive means containing a relatively high number of grains of explosive per unit length and extending within said tube coextensive with that portion of the tube to be expanded; detonator means disposed externally of said tube; an energy transfer cord extending said detonator means and said primary explosive means, said energy transfer cord including a relatively low number of grains of explosive per unit length which are insufficient to detonate said primary explosive means, and a sheath covering said latter grain of explosive, and being constructed and arranged to contain the debris and gases associated with the explosion of said latter grains of explosive; and booster means extending between said energy transfer cord and said primary explosive means, said booster means containing an explosive which is detonatable by said energy transfer cord and, upon exploding, is sufficient to detonate said primary explosive means, said explosive in said booster communicating with said primary explosive means through a small cavity positioned at an axial location with respect to said tube.

8. The apparatus of claim 7 further comprising an annular force transmitting member extending between said primary explosive means and said tube for transferring to said tube the energy resulting from the explosion of said primary explosive means.

9. The apparatus of claim 8 wherein a counterbore is formed in said force transmitting member adjacent one end thereof, said booster means being at least partially disposed in said counterbore and engaging in a friction fit with the wall of said force transmitting member defining said counterbore.

10. The apparatus of claim 9 wherein said booster means extends completely within said counterbore and flush with the end of said force transmitting member.

11. The apparatus of claim 9 wherein a portion of said booster means extends within said counterbore and a portion projects from said counterbore.

12. The apparatus of claim 9 wherein said booster means extends completely within said counterbore and in spaced relation to said one end of said force transmitting member.

13. The apparatus of claim 7 wherein said booster means is connected at one end to said energy transfer cord and its other end extends in a closely spaced relation to said primary explosive means.

* * * * *